United States Patent [19]

Lieb et al.

[11] Patent Number: 4,904,982

[45] Date of Patent: Feb. 27, 1990

[54] VISUAL AND AUDIBLE WARNING DEVICE

[75] Inventors: M. Jeremy Lieb, Northbrook; Paul T. Ng, Vernon Hills, both of Ill.

[73] Assignee: Outboard Marine Corporation, Waukegan, Ill.

[21] Appl. No.: 161,458

[22] Filed: Feb. 18, 1988

[51] Int. Cl.[4] ..... G08B 7/00

[52] U.S. Cl. ..... 340/326; 340/815.21; 368/255

[58] Field of Search ..... 340/326, 327, 815.21, 340/815.22, 384 E; 368/255; 381/152, 190; 310/321, 324

[56] References Cited

U.S. PATENT DOCUMENTS

| | | | |
|---|---|---|---|
| 3,281,783 | 10/1966 | Adams . | |
| 3,792,468 | 2/1974 | Bryan . | |
| 4,193,010 | 3/1980 | Kompanek . | |
| 4,287,509 | 9/1981 | Beggs . | |
| 4,352,961 | 10/1982 | Kumada . | |
| 4,374,377 | 2/1983 | Saito et al. . | |
| 4,496,247 | 1/1985 | Kumada | 368/255 |
| 4,518,946 | 5/1985 | Solomon . | |

FOREIGN PATENT DOCUMENTS

| | | | |
|---|---|---|---|
| 0097457 | 8/1979 | Japan | 368/255 |
| 0106387 | 8/1980 | Japan | 368/255 |
| 0079986 | 6/1981 | Japan | 368/255 |
| 0684496 | 9/1979 | U.S.S.R. | 368/255 |

*Primary Examiner*—Joseph A. Orsino
*Assistant Examiner*—Brian R. Tumm
*Attorney, Agent, or Firm*—Welsh & Katz, Ltd.

[57] ABSTRACT

A visual and audible warning device has a piezoelectric element operable to cause vibrations which are transmitted through a light transmitting member, and a light emitting element which upon actuation causes a visual warning to be transmitted through the light transmitting member. The visual and audible warnings transmitted by the light transmitting member are intended to attract the attention of the operator of a vehicle, such as a boat, above the sound of the engine or other noise. The device has circuit means coupled with the piezoelectric element and the light emitting element for causing a predetermined electrical signal to be applied to the piezoelectric element and causing energization of the light emitting element upon actuation. The device may include a housing having support portions for supporting the light transmitting member and one or more light emitting elements in position while sealing the light transmitting member and electronic components within the housing from the ambient atmosphere, including weather elements which may otherwise result in corrosion and failure of the device.

21 Claims, 3 Drawing Sheets

VISUAL AND AUDIBLE WARNING DEVICE

BACKGROUND OF THE INVENTION

1. Field of the Invention

This invention relates to No. B03840506 and more particularly, to a warning device operable to produce a visual and audible warning which is suitable for installation in a dashboard or other structure in the area of a vehicle operator.

2. Description of the Prior Art

In the operation of an engine in an environment, such as in a boating environment, where the sound of the engine or other noise frequently masks the sound of an audible warning signal it is particularly desirable to effectively alert the operator if the engine is operating abnormally. The warning devices commonly available for this purpose provide an audible signal, but as noted above, often are not heard over the sound of the engine or surrounding noise. A device providing a visual warning frequently will not attract the operator's attention as the operator must consider other parameters of the operation of the vehicle or vessel and observe the operation of vehicular traffic in the immediate area of his vehicle or vessel. The operator would be required to frequently scan the device in order to detect a visual signal.

An engine overload indicator device has been proposed for vehicles, such as trucks, in U.S. Pat. No. 3,281,783 which utilizes a switch controlled by intake manifold pressure of the engine, to actuate a warning light, an audio alarm, a recorder and a flasher when the manifold vacuum decreases to a predetermined level. While such a device may be useful in vehicles such as trucks, the several signalling devices and the switch components occupy a relatively large amount of space, and are not easily adaptable to a single compact warning device. Another alarm device has been developed for security systems in which both a flashing light and a bell alarm may be actuated upon the triggering of the system, usually upon an intruder entering the premises. Such a device is described in U.S. Pat. No. 4,518,946. Still another alarm system, as described in U.S. Pat. No. 4,287,509, was developed for fire and smoke and other emergency conditions in which a strobe lamp may be actuated to warn deaf or hearing impaired persons upon the actuation of the usual audible alarm system, such as a fire alarm. These systems and their components require a considerable amount of space, which is not a concern in the applications to which the described systems are intended. However, in the environment of an operator's cockpit or cabin, and particularly installation in a dashboard, a compact, unitary warning device is desired which upon actuation will attract more than a single sense of the operator.

Therefore, one object of the present invention is to provide an improved visual and audio warning device in which the warning or display components and the energizing elements occupy a minimal amount of space.

Another object of the present invention is to provide an improved visual and audio warning device wherein a single, planar element presents both the visual and audible warnings.

A further object of the invention is to provide an improved visual and audio warning device which is adapted to be installed as a single instrument in the dashboard of a vehicle or vessel.

Still another object of the present invention is to provide an improved visual and audio warning device which can be readily sealed to reduce the occurrence of corrosion in atmosphere conducive to corrosion.

A further object of the invention is to provide an improved, combined visual and audio warning device installable in the dashboard of a vehicle or vessel in which the means for presenting the visual and audio warnings is a planar element which can be mounted in a standard dashboard instrument space, so that the warnings are directed towards the operator to attract the operator's attention under a variety of conditions.

These and other objects and advantages of the present invention will be readily apparent to those skilled in the art from the following description.

SUMMARY OF THE INVENTION

In general, the objects and purposes of the invention are met by providing a visual and audible warning device having a light transmitting member operable to transmit vibrations, a piezoelectric element operable to cause vibrations transmittable by the light transmitting member, a light emitting element, and means coupled with the piezoelectric element and the light emitting element which upon actuation causes an audible warning signal to be emitted by the piezoelectric element and the light transmitting member and a visual warning to be transmitted by the light emitting element through the light transmitting member.

In the device of the present invention, the light transmitting member is preferably a translucent plate, but the plate can be transparent, if desired. Preferably, the light transmitting member forms the face plate of an instrument adapted to be installed in the dashboard of a vehicle or vessel. The piezoelectric element can comprise a resonator plate and a piezoelectric ceramic coating affixed to one surface of the resonator plate. Although the resonator plate can be of glass, as in U.S. Pat. No. 4,352,961, to form a transparent flat panel device, it is preferable to utilize a metallic resonator plate, such as the metallic diaphragm in U.S. Pat. No. 4,374,377 or the electrically conductive substrate as in U.S. Pat. No. 4,193,010. It is preferred to have the resonator plate affixed on one surface to the light transmitting member, and to have the piezoelectric ceramic coating affixed to the opposite surface of the resonator plate. A pair of contacts is provided in electrical contact with the opposing surfaces of the piezoelectric ceramic coating, conveniently by having one of the pair of contacts in electrical contact with the resonator plate if a conductive resonator plate is utilized, and having the other of the pair of contacts in electrical contact with the opposite surface of the piezoelectric ceramic coating. The pair of contacts are also connected to the means for causing a predetermined electrical signal and energizing the light emitting element, which means can comprise a conventional oscillator to drive the piezoelectric element. The piezoelectric ceramic coating is a coating or layer, which may be in the form of a disc, of piezoelectric material such as an interbonded mixture containing phosphorus, zirconium, titanium and chromium, as disclosed in U.S. Pat. No. 4,193,010, which may be chemically bonded to the resonator plate in a manner known to the art.

In accordance with the present invention, an electrical signal generated by the means for causing a predetermined electrical signal can be applied to the opposing surfaces of the piezoelectric ceramic coating when an abnormal condition occurs, causing the coating to produce vibrations in the resonator plate which are transmitted by the light transmitting member to the operator, while an energizing signal or pulse is generated and conducted to the light emitting element energizing the light emitting element and transmitting the light, i.e. the visual warning, through the light transmitting member.

In the device of the present invention, the several members and elements can be provided in a housing forming a compact instrument or gauge adapted to be installed in the standard instrument space in a dashboard of a vehicle or vessel. The housing is preferably cylindrical so as to be easily inserted in an opening in a dashboard with the housing supporting the light transmitting member along its marginal edges. Preferably the housing is formed to have an outside diameter of approximately two inches to fit a standard opening for instruments or gauges in a dashboard of a small boat. Affixed on one side to a portion of the light transmitting member within the housing is the resonator plate with the piezoelectric ceramic coating affixed to the opposing side of the resonator plate. The light emitting element, which in its simplest form is a lamp, is positioned and supported within the interior of the housing so that the light emitted by the element is directed to another portion of the first side of the light transmitting member for transmission therethrough. Also enclosed within the housing in its interior is the means for causing electrical signals. These electrical signals caused by the means therefor include signals within the predetermined range of frequencies and a light emitting element energizing signal. The means are coupled with the piezoelectric element and the light emitting means to achieve the desired results of the invention.

The instrument as described above embodying the present invention also includes sealing means positioned along the periphery of the light transmitting member between that member and the marginal edges of the housing, and bezel means positioned adjacent the opposite side of the light transmitting member along its marginal edge and cooperating with the housing for securing the light transmitting member to the sealing means and the housing. In its simplest form the bezel means can have internal threads and the housing corresponding external threads to enable securing the former to the latter with the light transmitting member and the sealing means secured therebetween. In this manner, the underside of the light transmitting member, the piezoelectric element, and the interior of the housing can be sealed from the ambient atmosphere by securing the bezel means to the housing with the light transmitting member and the sealing means therebetween.

In another embodiment of the present invention, a plurality of light emitting elements, such as lamps, are positioned and supported by and within the interior of the housing, in addition to the piezoelectric element and means which upon actuation causes an audible signal to be emitted by the piezoelectric element and causes a visual warning with a light emitting element portion Preferably each light emitting element is spaced substantially equally distant from adjacent light emitting elements spaced from the perimeter of the light transmitting member and the piezoelectric element. In this arrangement, the light emitting elements are selectively actuated by the means causing the visual warning and the audible warning, depending upon the particular abnormal condition of the engine for which a signal is desired, while the audible signal is provided to attract the operator's attention to observe the instrument to determine which light emitting element is actuated to signal the particular abnormal condition.

In this embodiment, the light emitting elements are positioned and supported within the housing so that the light emitted by each will be directed to selected separately discernible portions of the light transmitting member for transmission therethrough, while substantially shielding the light emitted therefrom from other separately discernible portions of the light transmitting member, so that each separately discernible portion can be identified. A suitable legend or symbol can be placed on or adjacent each separately discernible portion to alert the operator to the particular abnormal condition encountered.

Additionally, one or more gauges, such as pointing indicators can be supported within the housing between the light transmitting member and one or more light emitting elements or adjacent to the latter, to provide a quantitative determination of the extent of the abnormal condition or conditions, for example, in the manner in which gauges normally indicate the condition of the operation of an engine or other device. However, the device of the present invention also provides an audible warning in addition to the visual warning to alert the operator, and upon obtaining his attention, the gauge or gauges will apprise the operator of the nature and extent of the abnormal condition.

The device of the present invention can be further enhanced by the audible warning being produced by the device with a varying sound or a pulsed sound. The varying sound may be a repeating rising and falling range of tones, for example, of the type normally used by an alarm or a siren. Audible warnings of this type are more likely to attract the operator's attention. The varying sound may be produced by having the means causing the audible signal produce a varying or sweeping frequency or pulsed electrical signal which causes the piezoelectric element to generate corresponding varying vibrations to be transmitted by the light transmitting member. Additionally, the visual signal produced may be a flashing signal or a signal of varying intensity, for example, by utilizing the varying signal generated by the means causing the audible signal as the source for the visual warning signal as well.

The operation and construction of the visual and audible warning device of the present invention will be further understood from the following description of the drawings and preferred embodiments.

DETAILED DESCRIPTION OF THE PREFERRED EMBODIMENTS

Figure 1:
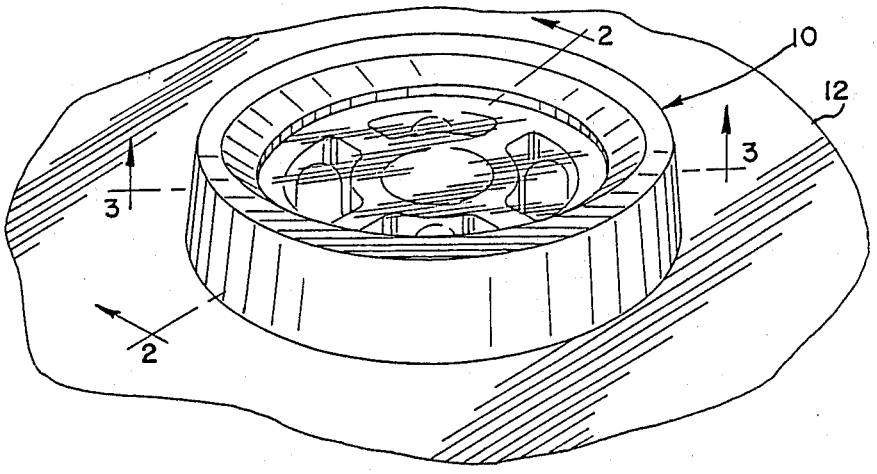
FIG. 1 is a partial perspective of an instrument embodying the present invention installed in a dashboard.
Figure 2:
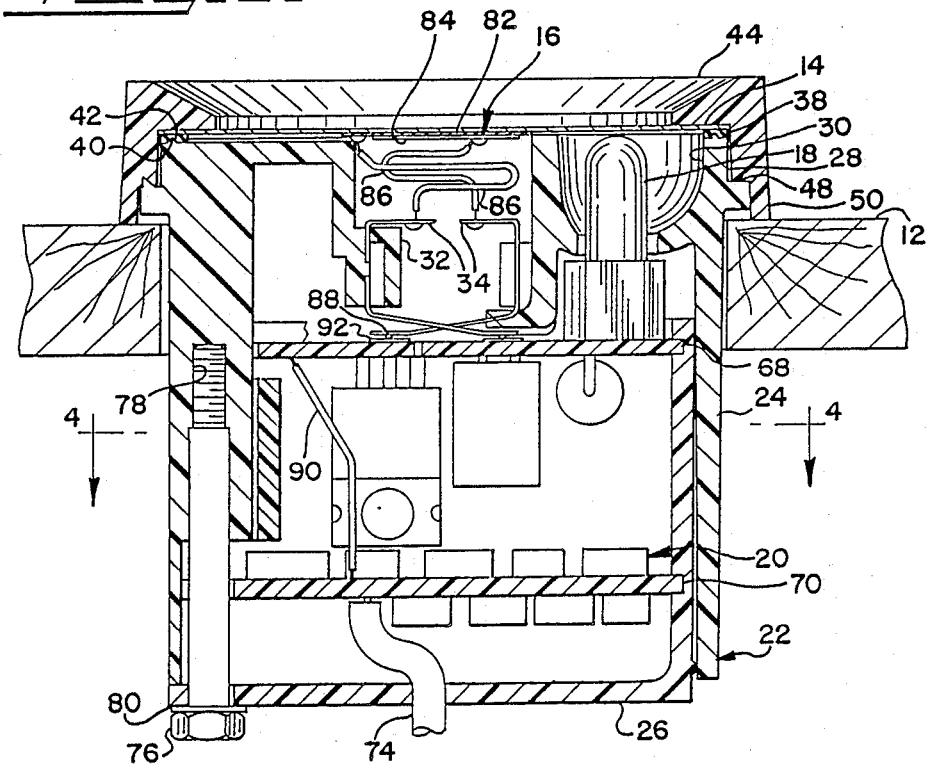
FIG. 2, is a partial sectional view taken along line 2—2 of FIG. 1.
Figure 3:
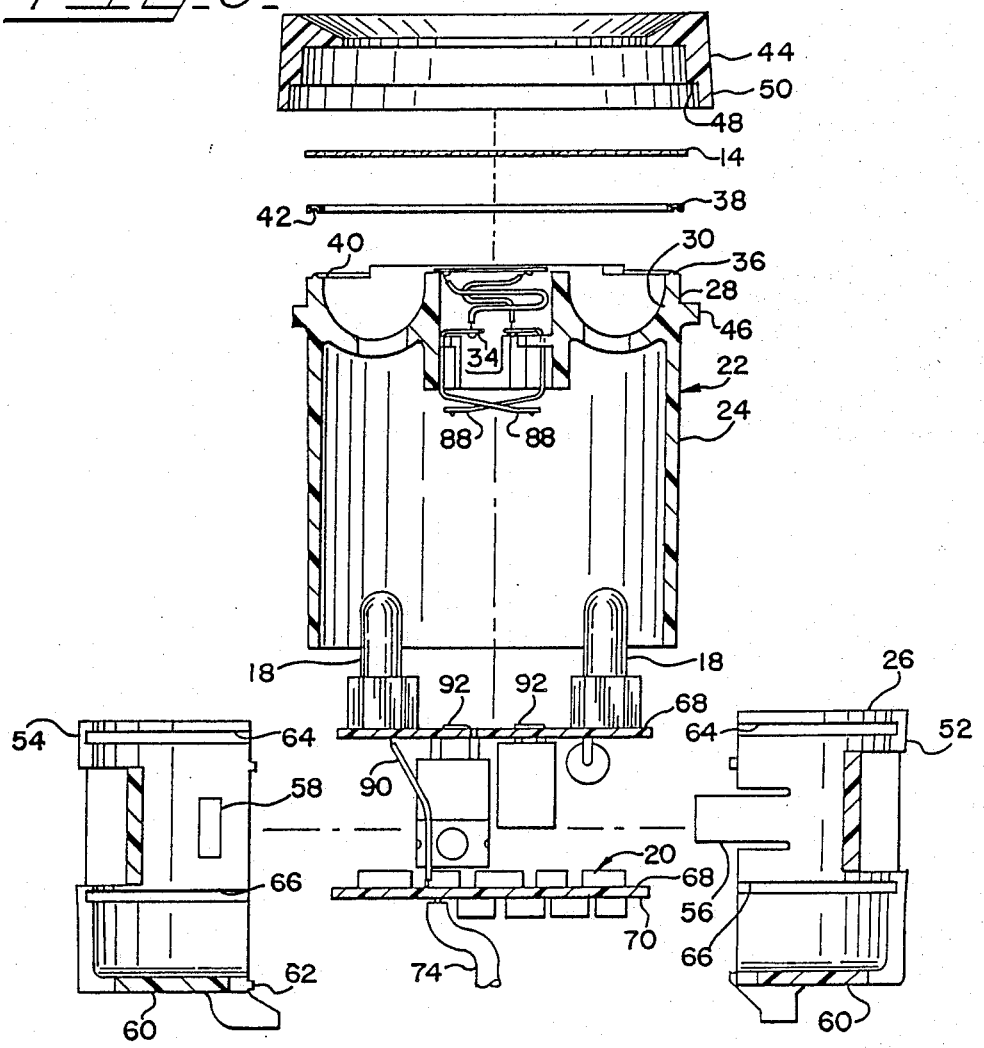
FIG. 3 is an exploded, sectional view of the device of the present invention taken along line 3—3 of FIG. 1.

Referring to the drawings, and particularly FIGS. 1–4, the reference numeral 10 generally indicates a visual and audible warning device in the form of an instrument mounted in a dashboard 12 of a powerboat. As best seen in FIGS. 2 and 3, device 10 includes a light transmitting member 14, a piezoelectrical element 16, at least one light emitting element, such as lamp 18 as shown, and circuit means, generally indicated by reference numeral 20, for causing a predetermined electrical signal and energizing the light emitting element or lamp 18 when actuated. These elements or components of the device of the present invention and their interaction will be described in greater detail below.

The elements or components 14–20 are positioned and supported in a housing 22 which includes an upper housing 24 and a lower housing 26. Upper housing 24 is generally cylindrical with an upper portion 28 having light directing or reflecting areas, hereinafter referred to as reflectors 30, and a central supporting structure 32 for supporting bent, spring-like contacts 34 for the piezoelectric element 16. The uppermost surface or marginal edge of upper housing 24 is substantially circular and forms a supporting edge 36 to support the light transmitting member 14. Interposed between supporting edge 36 of upper housing 24 and light transmitting member 14 is a substantially circular seal 38, which can be of rubber, preferably annular and dimensioned to closely fit with supporting edge 36. Supporting edge 36 may have an annular raised portion 40 and seal 38 may have an annular indentation 42 so that upon light transmitting member 14 being pressed against the upper surface of seal 38, the underside of light transmitting member 14 and the interior of the housing 22 will be substantially sealed from the ambient atmosphere.

Device 10 further includes a bezel 44 which can be positioned adjacent the upper side and along the marginal edge of light transmitting member 14. Upper housing 24 includes an annular outwardly extending flange 46 which cooperates with upper housing 24, for example, by providing corresponding screw threads (not shown) in flange 46 and the shoulder 48 or skirt portion 50 of bezel 44 to secure bezel 44 and the light transmitting member 14 to seal 38 and to the upper housing 24 of housing 20. It is contemplated that the lower portion of skirt 50 of bezel 44 will contact and rest against dashboard 12, as best shown in FIG. 2. Additionally, the outer surface of upper housing 24 can include external screw threads (not shown) so as to interact with a nut (not shown) in the area beneath or behind the dashboard to secure device 10 to dashboard 12. Alternatively, housing 24 can be formed with a lip or flange which will contact the back of dashboard 12 so that upon securing bezel 44 to the housing device 10 will be secured to dashboard 12 between skirt portion 50 of bezel 44 and the flange (not shown).

Lower housing 26 is preferably constructed in two generally semi-cylindrical sections 52, 54 adapted to be secured together to form an upwardly open hollow cylindrical chamber. To facilitate assembly, sections 52 and 54 include integral clips 56 and detents 58 which serve to secure the half sections together. Half sections 52 and 54 include bottom portions 60 which can have lugs 62 and corresponding detents in the other half section to facilitate assembly and sealing of housing 26 against the ambient atmosphere. Housing 26 includes annular recesses 64 and 66 which support circular circuit boards 68 and 70 which support components and connectors which are part of the circuit means 20. Additionally, bottom portion 60 of half sections 52 and 54 can include half apertures 72 for a cable 74 and one or more apertures (not shown) for additional cables (not shown) for a purpose to be hereinafter described. Lower housing 26 can be assembled by positioning circuit boards 68 and 70 in recesses 64 and 66, respectively, and positioning cable 74 in the aperture formed by half apertures 72 and applying pressure between half sections 52 and 54 to cause a snapping together of the half sections with clips 56 being engaged with the detents 58 in the opposing half sections. Lower housing 26 is configured to be cylindrical and insertable within the annular interior of upper housing 24 so that an enclosed interior space is formed.

Figure 4:
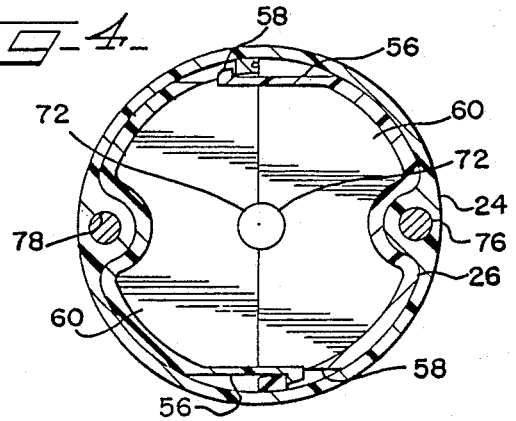
FIG. 4 is a cross-sectional view taken along line 4—4 of FIG. 2, but with the interior components of the instrument removed.

Upon assembly of the lower housing 26 into the interior of the upper housing 24, the former can be secured within the latter by means of bolts 76 received in bolt receiving bores 78 which may be at least partially threaded to receive and retain bolts 76. Additionally, a washer 80 may be included between the head of each bolt 76 and the bottom of lower housing 26. As shown in FIG. 4, portions of opposing sides of the housing may be enlarged to receive the bores 78, and the half sections 52 and 54 of lower housing 26 may contain U-shaped indentations to accommodate the interior surfaces of the enlargements of upper housing 24. Correspondingly, circuit boards 68 and 70, which are generally circular, will have U-shaped indentations, similar to the configuration of the bottom of lower housing 26 when assembled, so as to provide clearance for the bolts 76 and the interior curved portions of housing 26.

Light transmitting member 14 may be transparent, and may be a glass plate, but is preferably translucent, and preferably is formed of a synthetic resin, such as acrylic resin, such as that disclosed in U.S. Pat. No. 4,352,961 as in the transparent resonator plate in that patent. The light transmitting member 14 can be circular and utilized as the face plate of the instrument, as designated by the numeral 10, installed in the dashboard 12.

The piezoelectric element 16 preferably includes a resonator plate 82, which is preferably a metallic plate, which may be of steel or brass, as in the diaphragm disclosed in U.S. Pat. No. 4,374,377. Resonator plate 82 is affixed on one surface to the underside of the light transmitting member 14, by adhesion or bonding by an adhesive. Piezoelectric element 16 also includes a piezoelectric ceramic coating 84 bonded on the other surface of the resonator plate 82. Coating 84 is a coating or layer which may be in the form of a preformed disc of piezoelectric material as heretofore described. A pair of conductive wires 86 are soldered or otherwise conductively affixed to the resonator plate 82 and piezoelectric ceramic coating 84. The wires 86 are also soldered or otherwise conductively affixed to contacts 34. As shown in FIGS. 2 and 3, contacts 34 extend through their supports 32 to form downwardly extending spring contacts 88.

Circuit 20 includes circuit boards 68 and 70 which support components including a conventional oscillator suspended from the underside of board 68, several of which are supported by board 70, which in a manner known to the art together convert a signal from the engine (not shown) through cable 74, and cause a predetermined electrical signal to be generated to drive the piezoelectric element and to be transmitted through spring contacts 88, contacts 34 and wires 86 to piezoelectric element 16 and an energizing signal or series of pulses to one or several of selected lamps 18. In addition to the components which are actuated for this purpose, circuit boards 68 and 70 include connecting wires such as cable 90, which in the embodiment shown includes three or more wires connected between the boards to distribute the signals to the lamps 18 and to contacts 92 positioned on the upper surface of board 68. Contacts 92 are positioned on board 68 so as to be in electrical contact with spring contacts 88 upon insertion and securing of lower housing 26 within housing 22.

As noted above, circuit means 20 includes other components supported by boards 68 and 70, as shown in FIGS. 2 and 3 and other connecting wires (not shown) as apparent to those skilled in the art. For example, circuit means 20, in the embodiment shown, includes a transformer in a conventional oscillator which is used to drive the piezoelectric element 16 upon actuation at approximately 100 volts to obtain an audible signal transmitted by light transmitting member 14 of approximately 110 decibels. The electronic components, voltages, frequencies and other parameters are selected to operate to obtain a high sound pressure level, preferably at a detuned frequency which will vary so as to overcome the noise produced by one or a pair of engines, such as outboard engines, operated at wide open throttle. Furthermore, it may be desirable to have lamps 18 flash either initially or continually to assist in attracting the attention of the operator.

In accordance with this embodiment, the audible warning attracts the attention of the operator, while the light assists in such attraction, particularly at night, and provides visual indication of the nature of the abnormality, particularly where proper decals, symbols or legends are affixed or imprinted onto the light transmitting member 14 in the area of the selected lamps 18.

The embodiment described above is particularly advantageous as it provides an effective audible and visual warning device within the space of an instrument or gauge mounted on a dashboard of a vehicle, thus occupying a minimal amount of space. Additionally, the device can be mounted on a dashboard and directed towards the operator to ensure that proper corrective action will be taken by the operator as the warnings are directed toward the operator. As described above, upon assembly of bezel 44 to housing 22, the device is sealed against the ambient atmosphere, including weather elements, so as to reduce the occurrence of corrosion and failure of the instrument which may otherwise result.

Figure 5:
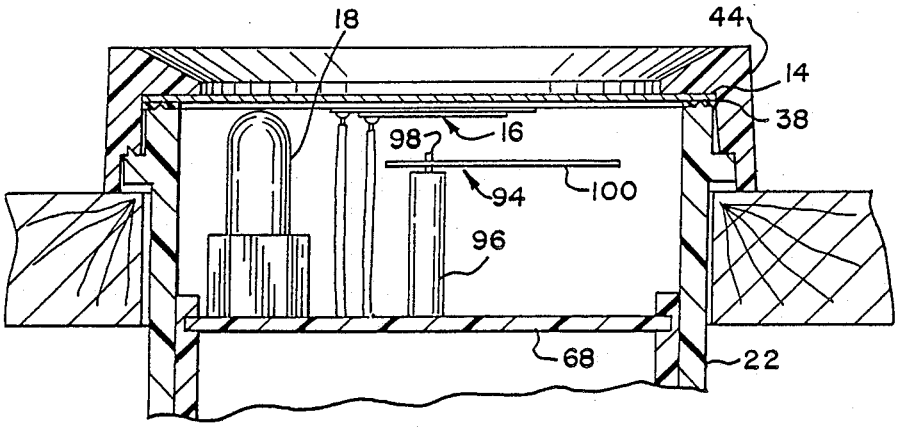
FIG. 5 is a fragmentary, sectional view of another embodiment of the present invention.

Another embodiment of the present invention is illustrated in FIG. 5, which is only a partial view, as the structure of the housing 22 and the circuit means 20 can be the same as in the previous embodiment. As a number of the components and elements are the same as in the previously described embodiments, the same reference numerals will be used for these elements. In this embodiment, a dial gauge 94 is included supported on circuit board 68, and is actuated by additional components of circuit means 20 as will be apparent to those skilled in the art. It is contemplated that the center post 96 and supporting shaft 98 for pointer 100 will not be seen as piezoelectric element 16 is positioned above post 96. In this embodiment, it is desirable to have the light transmitting member either transparent or only slightly translucent so that the pointer 100 of dial gauge 94 can be seen therethrough.

Also in this embodiment, it is contemplated that a single lamp 18 will be employed so that not only an audible signal and a visual signal will be transmitted to the operator through transmitting member 14 by piezoelectric element 16 and lamp 18, respectively, but also the extent of the abnormal condition can be determined by the operator viewing the pointer 100 of the dial gauge 94 through the light transmitting member 14. In this embodiment, the dial gauge 94, and optionally the lamp 18 at a low intensity level, can be continuously employed during operation of the engine to indicate the status of an engine parameter, while the warning system remains in readiness, and is actuated only upon the parameter reaching a predetermined abnormal state. At that time, a predetermined electrical signal is applied to the piezoelectric element 16 causing audible vibrations to be emitted through light transmitting member 14 and a light energizing signal to be applied to lamp 18 to cause a visual signal, for example, a more intense flashing light to be directed to the operator to attract his attention.

Additionally, several lamps 18 and dial gauges 94 can be included in the device to provide status indication of several parameters of the engine, and audible and visual warnings when any of the parameters of the engine operation reaches an abnormal condition.

Various changes coming within spirit of the invention may suggest themselves to those skilled in the art; hence, the invention is not limited to the specific embodiments shown or described and uses mentioned, but the same is intended to be merely exemplary, the scope of the invention being limited only by the appended claims.

We claim:

1. A visual audible warning device comprising:

a light transmitting member operable to at least transmit vibrations of a predetermined frequency, a piezoelectric element affixed to a portion of a first side of said light transmitting member operable to cause said vibrations upon receiving a predetermined electrical signal, said piezoelectric element comprising a metallic resonator plate affixed on one side thereof to said first side of said light transmitting member, and a piezoelectric ceramic coating affixed to an opposite side of said metallic resonator plate, said plate having a small dimension relative to said light transmitting member to permit light to be transmitted through a substantial portion of said light transmitting member, a plurality of illuminative light emitting elements positioned adjacent another portion of said first side of said light transmitting member, other than the portion to which said piezoelectric element is affixed, said light transmitting elements being spaced from the perimeter of the light transmitting member and spaced from the piezoelectric element, each of said light emitting elements being spaced substantially equally distant from adjacent light emitting elements, and means coupled with said piezoelectric element and said light emitting elements for causing said predetermined electrical signal to generate a plurality of signals, a first selected portion of said signals actuating said piezoelectric element and a second selected portion of said signals causing energization of said plurality of light emitting elements, whereby upon actuation of said means an audible warning signals is emitted by said piezoelectric element and said light transmitting member and a visual warning is transmitted by at least one of said light emitting elements through the light transmitting member so as to be visible in light or dark conditions.

2. A visual audible warning device comprising:

a light transmitting member having an outer periphery and being operable to at least transmit vibrations of a predetermined frequency, a piezoelectric element centrally affixed to a portion of a first side of said light transmitting member operable to cause said vibrations upon receiving a predetermined electrical signal, said piezoelectric element comprising a metallic resonator plate affixed on one side thereof to said first side of said light transmitting member, and a piezoelectric ceramic coating affixed to an opposite side of said metallic resonator plate, said plate having a small dimension relative to said light transmitting member to permit light to be transmitted around the periphery of said piezoelectric element and through a substantial portion of said light transmitting member, at least one lamp positioned adjacent another portion of said first side of said light transmitting member, and between the outer periphery of said piezoelectric element and the outer periphery of said light transmitting member, and means coupled with said piezoelectric element and said lamp for causing said predetermined electrical signal to actuate said piezoelectric element and illumination of said lamp, whereby upon actuation of said means an audible warning signal is emitted by said piezoelectric element and said light transmitting member and a visual warning is transmitted by said lamp through said light transmitting member so as to be visible in light or dark conditions.

3. A visual and audible warning device according to claim 2, wherein said metallic resonator plate is conductive and said piezoelectric element further includes a pair of contacts connected to said means for causing a predetermined electrical signal, one of said pair of contacts being in electrical contact with the surface of said piezoelectric ceramic coating opposite its surface affixed to said metallic resonator plate, and the other of said pair of contacts being in electrical contact with said metallic resonator plate, whereby an electrical signal generated by the means for causing a predetermined electrical signal can be applied to the opposing surfaces of the piezoelectric ceramic coating.

4. A visual and audible warning device according to claim 2 wherein said lamp is positioned along a circumference of said light transmitting member and spaced from said piezoelectric element.

5. A visual and audible warning device according to claim 2, having a plurality of said lamps positioned adjacent said first side of the light transmitting member at portions thereof other than the first portion to which the piezoelectric element is affixed, and said means for causing a predetermined electric signal being capable of generating a plurality of light energizing signals and being connected to said plurality of lamps, whereby generation of selected signals of the plurality of signals by said means will cause an audible warning signal to be emitted by the piezoelectric element and the light transmitting member and a visual warning to be emitted by at least one selected lamp energized by a selected energizing signal of the plurality of energizing signals from said means and transmitted through said light transmitted element.

6. A visual and audible warning device according to claim 5, wherein the light emitting elements are spaced from the perimeter of the light transmitting member and spaced from the piezoelectric element.

7. A visual and audible warning device according to claim 6, wherein each of the plurality of light emitting elements are spaced substantially equally distant from adjacent light emitting elements.

8. A visual and audible warning device according to claim 2, further comprising a housing having support portions for supporting said light transmitting member and said lamp in position adjacent said first side of the light transmitting member.

9. A visual and audible warning device according to claim 8, wherein sealing means is positioned between the housing and the light transmitting member for sealing the first side of the light transmitting member and the interior of the housing from the ambient atmosphere.

10. A visual and audible warning device according to claim 8, further comprising bezel means positioned adjacent the opposite side of the light transmitting member and along its marginal edge and cooperating with said housing for securing the light transmitting member to said housing.

11. A visual and audible warning device according to claim 10, wherein sealing means is positioned between the housing and the light transmitting member whereby the light transmitting member and the interior of the housing can be sealed from the ambient atmosphere by releasably securing the bezel means to said housing.

12. A visual and audible warning device according to claim 8, wherein said housing includes means for supporting said means for causing the predetermined electrical signal within the interior of the housing.

13. A visual and audible warning device according to claim 12, wherein sealing means is positioned between the housing and the light transmitting member for sealing the first side of the light transmitting member and the interior of the housing from the ambient atmosphere.

14. A visual and audible warning device according to claim 13, further comprising bezel means positioned adjacent the opposite side of the light transmitting member and along the marginal edge and cooperating with said housing for securing the light transmitting member to said sealing means and said housing, whereby the light transmitting member and the interior of the housing can be sealed from the ambient atmosphere by securing the bezel means to the housing.

15. A visual and audible warning device comprising:

(a) a light transmitting member operable to transmit vibrations of a predetermined range of frequencies;

(b) a housing supporting said light transmitting member along its marginal edges;

(c) a piezoelectric element comprising a metallic resonator plate affixed on one side to a portion of a first side of said light transmitting member and a piezoelectric ceramic coating affixed to the opposing side of said resonator plate, said plate having a small peripheral dimension relative to said light transmitting member to permit light to be transmitted around said element and through a substantial portion of said light transmitting member;

(d) a plurality of light emitting elements positioned and supported by and within the interior of said housing so that the light emitted by each of said light emitting elements will be directed to selected portions of said first side of said light transmitting member for transmission therethrough, said selected portions of the first side of the light transmitting member being spaced from the perimeter of said light transmitting member and spaced from said piezoelectric element;

each of the plurality of said light emitting elements being spaced substantially equally distant from adjacent light emitting elements from the perimeter of said light transmitting member and from said piezoelectric element, and supported by and within the interior of said housing so that the light emitted by each element of the plurality of light emitting elements will be directed to separately discernible portions of said light transmitting member for transmission therethrough; and (e) means coupled with said piezoelectric element and said light emitting means and supported by said housing in the interior thereof for causing electrical signals including signals within the predetermined range of frequencies and a light emitting element energizing signal, whereby upon actuation of said means, the electrical signals are caused to be applied to said piezoelectric and said light emitting elements, including signals within the predetermined range of frequencies, causing an audible warning signal to be emitted by said piezoelectric element and said light transmitting member and a visual warning signal transmitted by said light emitting elements through the light transmitting member so as to be visible in light or dark conditions.

16. A visual and audible warning device according to claim 15, having said plurality of said light emitting elements supported by and within the interior of said housing so that the light emitted by each of said light emitting elements will be directed to said selected portions of the first side of the light transmitting member for transmission therethrough, said selected portions of the first side of the light transmitting member being spaced from the perimeter of the light transmitting member and spaced from the piezoelectric element.

17. A visual and audible warning device according to claim 16, wherein said housing has supporting portions positioning each of said plurality of light emitting elements and directing the light emitted therefrom toward and defining the separately discernible portion of the light transmitting member, while substantially shielding the light emitted therefrom from other separately discernible portions of the light transmitting member.

18. A visual and audible warning device according to claim 17, further comprising sealing means positioned along the periphery of the first side of the light transmitting member and the housing, and bezel means positioned adjacent the opposite side of the light transmitting member along its marginal edge and cooperating with the housing for securing the light transmitting member to said sealing means and said housing, whereby the light transmitting member and the interior of the housing can be sealed from the ambient atmosphere by securing the bezel means to the housing with the light transmitting member and the sealing means therebetween.

19. A visual and audible warning device comprising:

a light transmitting member operable to at least transmit vibrations of a predetermined frequency;

a piezoelectric element affixed to a portion of a first side of said light transmitting member operable to cause said vibrations upon receiving a predetermined electrical signal, said piezoelectric element comprising a metallic resonator plate affixed on one side thereof to said first side of said light transmitting member, and a piezoelectric ceramic coating affixed to an opposite side of said metallic resonator plate, said plate having a small dimension relative to said light transmitting member to permit light to be transmitted through a substantial portion of said light transmitting member;

an illuminative light emitting element positioned adjacent another portion of said first side of said light transmitting member, and means coupled with said piezoelectric element and said light emitting element for causing said predetermined electrical signal to actuate said piezoelectric element and energization of said light emitting element;

a housing having support portions for supporting said light transmitting member and said light emitting element in position adjacent said first side of said light transmitting member, said housing including means for supporting said means for causing the predetermined electrical signal within the interior of the housing;

sealing means being positioned between said housing and the light transmitting member for sealing the first side of the light transmitting member and the interior of said housing from the ambient atmosphere; and bezel means positioned adjacent the opposite side of said light transmitting member and along its marginal edge and cooperating with said housing for securing said light transmitting member to said sealing means and said housing, whereby said light transmitting member and the interior of the housing can be sealed from the ambient atmosphere by securing said bezel means to said housing;

whereby upon actuation of said means an audible warning signal is emitted by said piezoelectric element and said light transmitting member and a visual warning is transmitted by said light emitting element through the light transmitting member so as to be visible in light or dark conditions.

20. A visual and audible warning device comprising:

(a) a light transmitting member operable to transmit vibrations of a predetermined range of frequencies;

(b) a housing supporting said light transmitting member along its marginal edges;

(c) a piezoelectric element comprising a metallic resonator plate substantially centered and affixed on one side to a portion of a first side of said light transmitting member and a piezoelectric ceramic coating affixed to the opposing side of the resonator plate, (d) a plurality of light emitting elements positioned and supported by and within the interior of said housing, each light emitting element being spaced substantially equally distant from adjacent light emitting elements and from the perimeter of the light transmitting member, so that the light emitted by each of said light emitting elements will be directed to selected separately discernible portions of said first side of the light transmitting member for transmission therethrough, while substantially shielding the light emitted therefrom from other separately discernible portions of the light transmitting member, said selected portions of the first side of the light transmitting member being spaced from the perimeter of the light transmitting member and spaced from the piezoelectric element, (e) sealing means positioned along the periphery of the first side of the light transmitting member of the housing, (f) bezel means positioned adjacent the opposite side of the light transmitting member along its marginal edge and cooperating with the housing for securing the light transmitting member along its marginal edge and cooperating with the housing for securing the light transmitting member to said sealing means and said housing, whereby the light transmitting member and the interior of the housing can be sealed from the ambient atmosphere by securing the bezel means to the housing with the light transmitting member and the sealing means therebetween, and (g) means coupled with said piezoelectric element and said light emitting means and supported by said housing in the interior thereof for causing electrical signals including signals within the predetermined range of frequencies and generating a plurality of light energizing signals and being connected to said piezoelectric element and said plurality of light emitting elements, whereby upon actuation of said means the electrical signals are caused to be applied to said piezoelectric element and said light emitting elements, including signals within the predetermined range of frequencies, causing an audible warning signal to be emitted by said piezoelectric element and said light transmitting member and a visual warning signal transmitted through at least one of the separately discernible portions of the light transmitting member.

21. A visual and audible warning device comprising:

a light transmitting member operable to at least transmit vibrations of a predetermined frequency;

a piezoelectric element affixed to a portion of a first side of said light transmitting member operable to cause said vibrations upon receiving a predetermined electrical signal, said piezoelectric element comprising a metallic resonator plate affixed on one side thereof to said first side of said light transmitting member, and a piezoelectric ceramic coating affixed to an opposite side of said metallic resonator plate, said plate having a small dimension relative to said light transmitting member to permit light to be transmitted through a substantial portion of said light transmitting member;

an illuminative light emitting element positioned adjacent another portion of said first side of said light transmitting member, and means coupled with said piezoelectric element and said light emitting element for causing said predetermined electrical signal to actuate said piezoelectric element and energization of said light emitting element;

a housing having support portions for supporting said light transmitting member and said light emitting element in position adjacent said first side of said light transmitting member;

bezel means positioned adjacent the opposite side of said light transmitting member and along its marginal edge and cooperating with said housing for securing said light transmitting member to said housing; and whereby upon actuation of said means an audible warning signal is emitted by said piezoelectric element and said light transmitting member and a visual warning is transmitted by said light emitting element through the light transmitting member so as to be visible in light or dark conditions.

* * * * *